US010885921B2

(12) United States Patent
Atti et al.

(10) Patent No.: US 10,885,921 B2
(45) Date of Patent: Jan. 5, 2021

(54) MULTI-STREAM AUDIO CODING

(71) Applicant: QUALCOMM Incorporated, San Diego, CA (US)

(72) Inventors: Venkatraman Atti, San Diego, CA (US); Venkata Subrahmanyam Chandra Sekhar Chebiyyam, Santa Clara, CA (US); Daniel Jared Sinder, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 137 days.

(21) Appl. No.: 16/016,842

(22) Filed: Jun. 25, 2018

(65) Prior Publication Data

US 2019/0013028 A1 Jan. 10, 2019

Related U.S. Application Data

(60) Provisional application No. 62/529,770, filed on Jul. 7, 2017.

(51) Int. Cl.

| | |
|---|---|
| ***G10L 19/008*** | (2013.01) |
| ***G10L 19/02*** | (2013.01) |
| ***G10L 19/16*** | (2013.01) |
| ***G10L 19/24*** | (2013.01) |

(52) U.S. Cl.

CPC ..... *G10L 19/008* (2013.01); *G10L 19/02* (2013.01); *G10L 19/167* (2013.01); *G10L 19/24* (2013.01)

(58) Field of Classification Search

CPC ..... G10L 19/008; G10L 19/02; G10L 19/167; G10L 19/24

See application file for complete search history.

(56) References Cited

U.S. PATENT DOCUMENTS

| | | | | |
|---|---|---|---|---|
| 6,230,130 | B1 * | 5/2001 | Castello da Costa | H04N 21/4341 370/267 |
| 6,581,032 | B1 | 6/2003 | Gao et al. | |
| 8,891,776 | B2 * | 11/2014 | Ramamoorthy | G10L 19/0212 381/22 |
| 2015/0340044 | A1 * | 11/2015 | Kim | G10L 19/008 381/23 |
| 2016/0255348 | A1 * | 9/2016 | Panchagnula | H04N 19/196 375/240.02 |

FOREIGN PATENT DOCUMENTS

| | | | | |
|---|---|---|---|---|
| WO | 2015146057 | A1 | 10/2015 | |
| WO | WO-2015146057 | A1 * | 10/2015 | G10L 19/24 |
| WO | 2016163327 | A1 | 10/2016 | |

OTHER PUBLICATIONS

International Search Report and Written Opinion—PCT/US2018/039435—ISA/EPO—dated Sep. 4, 2018.

* cited by examiner

*Primary Examiner* — Nafiz E Hoque
(74) *Attorney, Agent, or Firm* — Moore IP

(57) ABSTRACT

A method includes receiving, at an audio encoder, multiple streams of audio data. The method includes assigning a priority to each stream of the multiple streams and determining, based on the priority of each stream of the multiple streams, a permutation sequence for encoding of the multiple streams. The method also includes encoding at least a portion of each stream of the multiple streams according to the permutation sequence.

30 Claims, 7 Drawing Sheets

MULTI-STREAM AUDIO CODING

I. CROSS REFERENCE TO RELATED APPLICATIONS

The present application claims the benefit of U.S. Provisional Patent Application No. 62/529,770, entitled "MULTI-STREAM AUDIO CODING," filed Jul. 7, 2017, which is expressly incorporated by reference herein in its entirety.

II. FIELD

The present disclosure is generally related to encoding of multiple audio signals.

III. DESCRIPTION OF RELATED ART

Advances in technology have resulted in smaller and more powerful computing devices. For example, a variety of portable personal computing devices, including wireless telephones such as mobile and smart phones, tablets and laptop computers are small, lightweight, and easily carried by users. These devices can communicate voice and data packets over wireless networks. Further, many such devices incorporate additional functionality such as a digital still camera, a digital video camera, a digital recorder, and an audio file player. Also, such devices can process executable instructions, including software applications, such as a web browser application, that can be used to access the Internet. As such, these devices can include significant computing capabilities.

A computing device may include or may be coupled to multiple microphones to receive audio signals. The audio signals may be processed into audio data streams according to a particular audio format, such as a two-channel stereo format, a multichannel format such as 5.1 or a 7.1 format, a scene-based audio format, or one or more other formats. The audio data streams may be encoded by an encoder, such as a coder/decoder (codec) that is designed to encode and decode audio data streams according to the audio format. Because a variety of audio formats are available that provide various benefits for particular applications, manufacturers of such computing devices may select a particular audio format for enhanced operation of the computing devices. However, communication between devices that use different audio formats may be limited by lack of interoperability between the audio formats. In addition, a quality of encoded audio data transferred across a network between devices that use compatible audio formats may be reduced due to limited transmission bandwidth of the network. For example, the audio data may have to be encoded at a sub-optimal bit rate to comply with the available transmission bandwidth, resulting in a reduced ability to accurately reproduce the audio signals during playback at the receiving device.

IV. SUMMARY

In a particular implementation, a device includes an audio processor configured to generate multiple streams of audio data based on received audio signals. The device also includes an audio encoder configured to assign a priority to each stream of the multiple streams. The audio encoder is also configured to determine, based on the priority of each stream of the multiple streams, permutation sequence for encoding the multiple streams, and to encode at least a portion of each stream of the multiple streams according to the permutation sequence.

In another particular implementation, a method includes receiving, at an audio encoder, multiple streams of audio data and assigning a priority to each stream of the multiple streams. The method includes determining, based on the priority of each stream of the multiple streams, a permutation sequence for encoding the multiple streams. The method also includes encoding at least a portion of each stream of the multiple streams according to the permutation sequence.

In another particular implementation, a non-transitory computer-readable medium includes instructions that, when executed by a processor within a processor, cause the processor to perform operations including receiving, at the audio encoder, multiple streams of audio data. The operations also include assigning a priority to each stream of the multiple streams and determining, based on the priority of each stream of the multiple streams, a permutation sequence for encoding the multiple streams. The operations also include encoding at least a portion of each stream of the multiple streams according to the permutation sequence.

In another particular implementation, an apparatus includes means for assigning a priority to each stream of multiple streams of audio data and for determining, based on the priority of each stream of the multiple streams, a permutation sequence for encoding the multiple streams. The apparatus also includes means for encoding at least a portion of each stream of the multiple streams according to the permutation sequence.

Other implementations, advantages, and features of the present disclosure will become apparent after review of the entire application, including the following sections: Brief Description of the Drawings, Detailed Description, and the Claims.

V. BRIEF DESCRIPTION OF THE DRAWINGS

VI. DETAILED DESCRIPTION

Particular aspects of the present disclosure are described below with reference to the drawings. In the description, common features are designated by common reference numbers. As used herein, various terminology is used for the purpose of describing particular implementations only and is not intended to be limiting of implementations. For example, the singular forms "a," "an," and "the" are intended to include the plural forms as well, unless the context clearly indicates otherwise. It may be further understood that the terms "comprises" and "comprising" may be used interchangeably with "includes" or "including." Additionally, it will be understood that the term "wherein" may be used interchangeably with "where." As used herein, an ordinal term (e.g., "first," "second," "third," etc.) used to modify an element, such as a structure, a component, an operation, etc., does not by itself indicate any priority or order of the element with respect to another element, but rather merely distinguishes the element from another element having a same name (but for use of the ordinal term). As used herein, the term "set" refers to one or more of a particular element, and the term "plurality" refers to multiple (e.g., two or more) of a particular element.

In the present disclosure, terms such as "determining", "calculating", "shifting", "adjusting", etc. may be used to describe how one or more operations are performed. It should be noted that such terms are not to be construed as limiting and other techniques may be utilized to perform similar operations. Additionally, as referred to herein, "generating", "calculating", "using", "selecting", "accessing", and "determining" may be used interchangeably. For example, "generating", "calculating", or "determining" a parameter (or a signal) may refer to actively generating, calculating, or determining the parameter (or the signal) or may refer to using, selecting, or accessing the parameter (or signal) that is already generated, such as by another component or device.

Systems and devices operable to encode and decode multiple audio signals are disclosed. A device may include an encoder configured to encode the multiple audio signals. The multiple audio signals may be captured concurrently in time using multiple recording devices, e.g., multiple microphones. In some examples, the multiple audio signals (or multi-channel audio) may be synthetically (e.g., artificially) generated by multiplexing several audio channels that are recorded at the same time or at different times. As illustrative examples, the concurrent recording or multiplexing of the audio channels may result in a 2-channel configuration (i.e., Stereo: Left and Right), a 5.1 channel configuration (Left, Right, Center, Left Surround, Right Surround, and the low frequency emphasis (LFE) channels), a 7.1 channel configuration, a 7.1+4 channel configuration, a 22.2 channel configuration, or a N-channel configuration.

Figure 1:
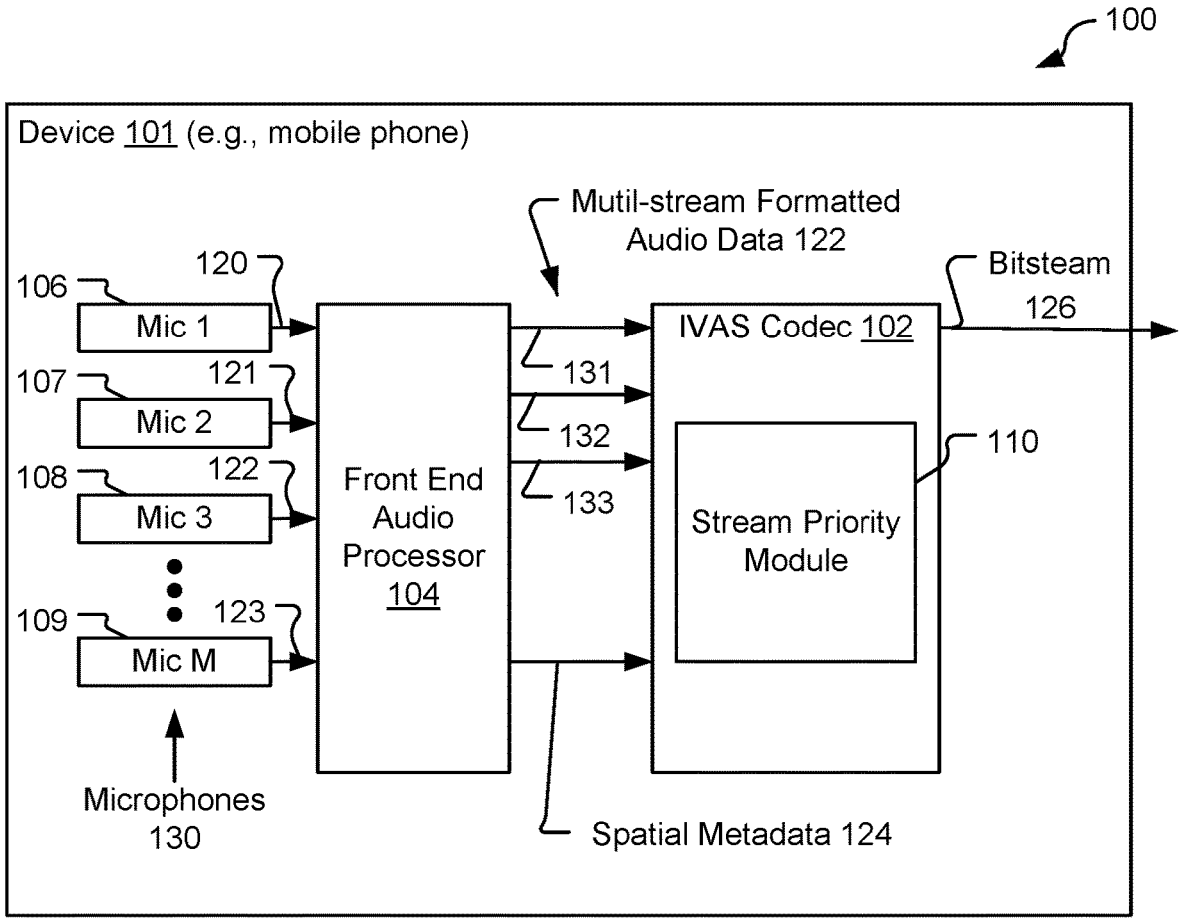
FIG. 1 is a block diagram of a particular illustrative example of a system that includes an immersive voice and audio services (IVAS) codec operable to perform multiple-stream encoding.

FIG. 1 depicts an example of a system 100 that includes a device 101 that has multiple microphones 130 coupled to a front end audio processor 104. The front end audio processor 104 is coupled to a codec 102, such as an immersive voice and audio services (IVAS) codec 102. The IVAS codec 102 is configured to generate a bit stream 126 that includes encoded data that is received via multiple audio streams from the front end audio processor 104. The IVAS codec 102 includes a stream priority module 110 that is configured to determine a priority configuration of each of the received audio streams and to encode the audio streams based on the determined priorities (e.g., perceptually more important, more "critical" sound to the scene, background sound overlays on top of the other sounds in a scene, directionality relative to diffusiveness, etc.), to generate the bit stream 126. In another example embodiment, the stream priority module 110 may determine the priority or permutation sequence for encoding based on the spatial metadata 124. The stream priority module 110 may also be referred to as a stream configuration module or stream pre-analysis module. Determining a priority configuration of each of the audio streams and encoding each audio stream based on its priority enables the IVAS codec 102 to allocate different bit rates and use different coding modes, coding bandwidths. In an example embodiment, the IVAS codec 102 may allocate more bits to streams having higher priority than to streams having lower priority, resulting in a more effective use of transmission resources (e.g., wireless transmission bandwidth) for sending the bit stream 126 to a receiving device. In another example embodiment, the IVAS codec 102 may encode up to super-wideband (i.e., bandwidth up to e.g., 16 kHz) for the higher priority configuration streams, while encoding up to only wideband (i.e., bandwidth up to e.g., 8 kHz) for the lower priority configuration streams.

The microphones 130 include a first microphone 106, a second microphone 107, a third microphone 108, and an M-th microphone 109 (M is a positive integer). For example, the device 101 may include a mobile phone, and the microphones 106-109 may be positioned at various locations of the device 101 to enable capture of sound originating from various sources. To illustrate, in a particular implementation one or more of the microphones 130 is positioned to capture speech from a user (e.g., during a telephone call or teleconference), one or more of the microphones 130 is positioned to capture audio from other sources (e.g., to capture three-dimensional (3D) audio during a video recording operation), and one or more of the microphones 130 is configured to capture background audio. In a particular implementation, two or more of the microphones 130 are arranged in an array or other configuration to enable audio processing techniques such as echo cancellation or beam forming, as illustrative, non-limiting examples. Each of the microphones 106-109 is configured to output a respective audio signal 120-123.

The front end audio processor 104 is configured receive the audio signals 120-123 from the microphones 130 and to process the audio signals 120-123 to generate multi-stream formatted audio data 122. In a particular implementation, the front-end audio processor 104 is configured to perform one or more audio operations, such as echo-cancellation, noise-suppression, beam-forming, or any combination thereof, as illustrative, non-limiting examples.

The front end audio processor 104 is configured to generate audio data streams resulting from the audio operations, such as a first stream 131, a second stream 132, and an N-th stream 133 (N is a positive integer). In a particular implementation, the streams 131-133 include pulse-code modulation (PCM) data and have a format that is compatible with an input format of the IVAS codec 102.

For example, in some implementations the streams 131-133 have a stereo format with the number "N" of channels to be coded equal to two. The channels may be correlated or may be not correlated. The device 101 may support two or more microphones 130, and the front-end audio processor 104 may be configured to perform echo-cancellation, noise-suppression, beam-forming, or a combination thereof, to generate a stereo signal with an improved signal-to-noise ratio (SNR) without altering the stereo/spatial quality of the generated stereo signal relative to the original stereo signal received from the microphones 130.

In another implementation, the streams 131-133 are generated by the front end audio processor 104 to have a format based on ambisonics or scene-based audio (SBA) in which the channels may sometimes include Eigen-decomposed coefficients corresponding to the sound scene. In other implementations, the streams 131-133 are generated by the front end audio processor 104 to have a format corresponding to a multichannel (MC) configuration, such as a 5.1 or 7.1 surround sound configuration, as illustrative, non-limiting examples.

In other alternative implementations, the audio streams 131-133 may be provided to the IVAS Codec 102 may have been received differently than any of the front-end processing examples illustrated above.

In some implementations, the streams 131-133 have an independent streams (IS) format in which the two or more of the audio signals 120-123 are processed to estimate the spatial characteristics (e.g., azimuth, elevation, etc.) of the sound sources. The audio signals 120-123 are mapped to independent streams corresponding to sound sources and the corresponding spatial metadata 124.

In some implementations, the front end audio processor 104 is configured to provide the priority configuration information to the IVAS codec 102 to indicate a relative priority or importance of one or more of the streams 131-133. For example, when the device 101 is operated by a user in a telephonic mode, a particular stream associated with the user's speech may be designated by the front end audio processor 104 as having a higher priority than the other streams output to the IVAS codec 102.

The IVAS codec 102 is configured to encode the multi-stream formatted audio data 122 to generate the bit stream 126. The IVAS codec 102 is configured to perform encoding of the multi-stream audio data 122 using one or more encoders within the IVAS codec 102, such as an algebraic code-excited linear prediction (ACELP) encoder for speech and a frequency domain (e.g., modified discrete cosine transform (MDCT)) encoder for non-speech audio. The IVAS codec 102 is configured to encode data that is received via one or more of a stereo format, an SBA format, an independent streams (IS) format, a multi-channel format, one or more other formats, or any combination thereof.

The stream priority module 110 is configured to assign a priority to each stream 131-133 in the multi-stream formatted audio data 122. The stream priority module 110 is configured to determine a priority of each of the streams based on one or more characteristics of the signal corresponding to the stream, such as signal energy, foreground vs. background, content type, or entropy, as illustrative, non-limiting examples. In an implementation in which the stream priority module 110 receives stream priority information (e.g., the information may include tentative or initial bit rates for each stream, priority configuration or ordering of each of the streams, grouping information based on the scene classification, sample rate or bandwidth of the streams, other information, or a combination thereof) from the front end audio processor 104, the stream priority module 110 may assign priority to the streams 131-133 at least partially based on the received stream priority information. An illustrative example of priority determination of audio streams is described in further detail with reference to FIG. 3.

The IVAS codec 102 is configured to determine, based on the priority of each of the multiple streams, an analysis and encoding sequence of the multiple streams (e.g., an encoding sequence of frames of each of the multiple streams). In a particular implementation, the streams having higher priority are encoded prior to encoding streams having lower priority. To illustrate, the stream having the highest priority of the streams 131-133 is encoded prior to encoding of the other streams, and the stream having the lowest priority of the streams 131-133 is encoded after encoding the other streams.

In some implementations, the IVAS codec 102 is configured to encode streams having higher priority using a higher bit rate than is used for encoding streams having lower priority for the majority of the frames. For example, twice as many bits may be used for encoding a portion (e.g., a frame) of a high-priority stream as compared to a number of bits used for encoding an equally-sized portion (e.g., a frame) of a low-priority stream. Because an overall bit rate for transmission of the encoded streams via the bitstream 126 is limited by an available transmission bandwidth for the bitstream 126, encoding higher-priority streams with higher bit rates provides a larger number of bits to convey the information of higher-priority streams, enabling a higher-accuracy reproduction of the higher-priority streams at a receiver as compared to lower-accuracy reproduction that is enabled by the lower number of bits that convey the information of the lower-priority streams.

Determination of priority may be performed for each session or each portion or "frame" of the received multi-stream formatted audio data 122. In a particular implementation, each stream 131-133 includes a sequence of frames that are temporally aligned or synchronized with the frames of the others of the streams 131-133. The stream priority module 110 may be configured to process the streams 131-133 frame-by-frame. For example, the stream priority module 110 may be configured to receive an i-th frame (where i is an integer) of each of the streams 131-133, analyze one or more characteristics of each stream 131-133 to determine a priority for the stream corresponding to the i-th frame, generate a permutation sequence for encoding the i-th frame of each stream 131-133 based on the determined priorities, and encode each i-th frame of each of the streams 131-133 according to the permutation sequence. After encoding the i-th frames of the streams 131-133, the stream priority module 110 continues processing of a next frame (e.g., frame i+1) of each of the streams 131-133 by determining a priority for each stream based on the (i+1)-th frames, generating a permutation sequence for encoding the (i+1)-th frames, and encoding each of the (i+1)-th frames. A further example of frame-by-frame stream priority determination and encoding sequence generation is described in further detail with reference to FIG. 3.

In some implementations, the stream priority, permutation sequence, and encoding bit rate are interdependent such that streams with higher priority are assigned earlier positions in the permutation sequence and higher bit rates, and streams with lower priority are assigned later positions in the permutation sequence and lower bit rates. In other implementations, permutation sequence may be independent of bit rate. For example, a stream estimated to be relatively efficiently encodable (e.g., encodable relatively quickly, using relatively few processing resources, or both) may be assigned a first position in the permutation sequence, even if the stream has a relatively low priority and is encoded at a relatively low bit rate, so that an available bit rate that remains for encoding and therefore a bit allocation of the remaining streams can be determined relatively quickly and accurately by the IVAS codec 102. In an example implementation, a stream may be changed from an initial selection of higher priority to lower priority and a correspondingly a different permutation coding sequence may be employed based on the source-signal characteristics (e.g., background noise) on a frame-by-frame processing. As another example, a stream having an uncertain encoding estimate, such as due to high variation in encoding rate in prior frames of the stream, may be assigned a first position in the permutation sequence, so that an available remaining bit rate and therefore a bit allocation for the other streams can be accurately determined. Thus, in some implementations streams having higher bit rates are positioned earlier in the permutation sequence, in other implementations streams having lower bit rates are positioned earlier in the permutation sequence, in some implementations streams with relatively high encoding variability are positioned earlier in the permutation sequence, and in other implementations streams with relatively low encoding variability are positioned earlier in the permutation sequence. The IVAS codec 102 may support any or all such implementations and may adjust a mode of operation to switch between such implementations, such as based on a prediction of which implementation is appropriate for a given frame of the audio streams, based on a history of encoding prior frames of the audio streams, or a combination thereof.

The IVAS codec 102 is configured to combine the encoded portions of the streams 131-133 to generate the bitstream 126. In a particular implementation, the bitstream 126 has a frame structure in which each frame of the bitstream 126 includes an encoded frame of each of the streams 131-133. In an illustrative example, an i-th frame of the bitstream 126 includes the encoded i-th frame of each of the streams 131-133, along with metadata such as a frame header, stream priority information or bit rate information, location metadata, etc. An illustrative example of a format of the bitstream 126 is described in further detail with reference to FIG. 4.

During operation, the front end audio processor 104 receives the M audio signals 120-123 from the M microphones 106-109, respectively, and performs front-end processing to generate the N streams 131-133. In some implementations N is equal to M, but in other implementations N is not equal to M. For example, M is greater than N when multiple audio signals from the microphones 106-109 are combined via beam-forming into a single stream.

The format of the streams 131-133 may be determined based on the positions of the microphone 106-109, the types of microphones, or a combination thereof. In some implementations the stream format is configured by a manufacturer of the device 101. In some implementations the stream format is controlled or configured by the front end audio processor 104 to the IVAS codec 102 based on an application scenarios (e.g., 2-way conversational, conferencing) of the device 101. In other cases, the stream format may also be negotiated between the device 101 and a corresponding Bitstream 126 recipient device (e.g., a device containing an IVAS decoder which decodes the Bitstream 126) in case of streaming or conversational communication use cases. The spatial metadata 124 is generated and provided to the IVAS codec 102 in certain circumstances, such as e.g., when the streams 121-124 have the independent streams (IS) format. In other formats, e.g., stereo, SBA, MC, the spatial metadata 124 may be derived partially from the front end audio processor 104. In an example embodiment, the spatial metadata may be different for the different input formats and may also be embedded in the input streams.

The IVAS codec 102 analyzes the streams 131-133 and determines a priority configuration of each of the streams 131-133. The IVAS codec 102 allocates higher bit rates to streams having the highest priority and lower bit rates to streams having lower priority. The IVAS codec 102 encodes the streams 131-133 based on the priority and combines the resulting encoded stream data to generate the output bitstream 126.

Determining a priority of each of the audio streams 131-133 and encoding each audio stream based on its priority enables the IVAS codec 102 to allocate higher bit rates to streams having higher priority and lower bit rates to streams having lower priority. Because encoding a signal using a higher bit rate enables higher accuracy reproduction of the original signal at a receiving device, higher accuracy may be attained at the receiving device during reconstruction of more important audio streams, such as speech or acoustical sounds, as compared to a lower accuracy of reproducing the lower-priority audio streams, such as background noise. As a result, transmission resources are used more effectively when sending the bitstream 126 to a receiving device.

Although the system 100 is illustrated as including four microphones 106-109 (e.g., M=4), in other implementations the system 100 may include a different number of microphones, such as two microphones, three microphones, five microphones, or more than five microphones. Although the system 100 is illustrated as generating three audio streams 131-133, (e.g., N=3), in other implementations the system 100 may generate a different number of audio streams, such as two audio streams, four audio streams, or more than four audio streams. Although the front end audio processor 104 is described as providing spatial metadata 124 to support one or more audio formats such as independent streams (IS) format, in other implementations the front end audio processor 104 may not provide spatial metadata to the IVAS codec 102, such as an implementation in which the front end audio processor 104 does not provide explicit spatial metadata but incorporate in the streams itself, e.g., constructing one primary stream and other secondary streams to reflect the spatial metadata. Although the system 100 is implemented in a single device 101, in other implementations one or more portions of the system 100 may be implemented in separate devices. For example, one or more of the microphones 106-109 may be implemented at a device (e.g., a wireless headset) that is coupled to the front end audio processor 104, the front end audio processor 104 may be implemented in a device that is separate from but communicatively coupled to the IVAS codec 102, or a combination thereof.

Figure 2:
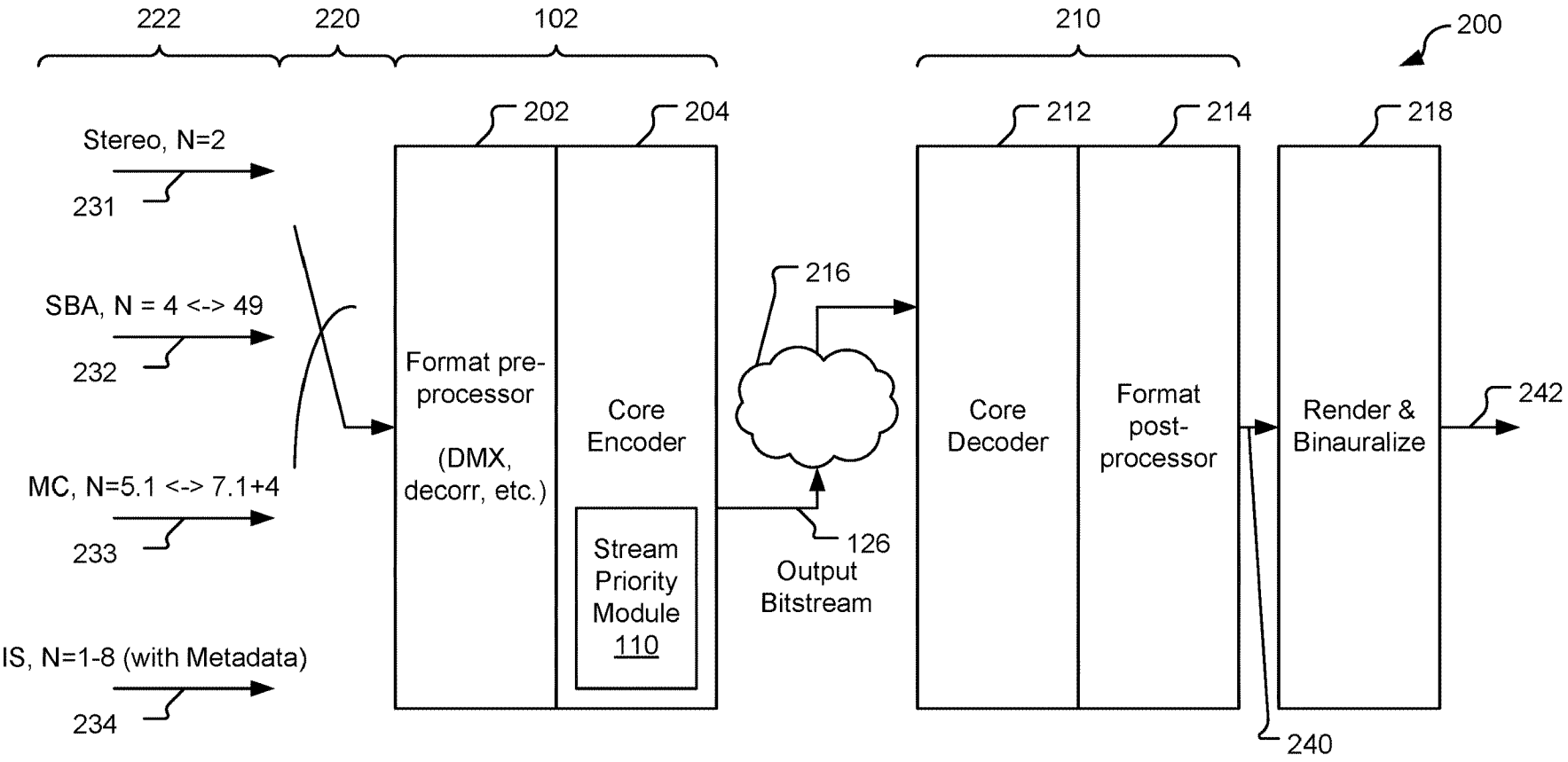
FIG. 2 is a block diagram of another particular example of a system that includes the codec of FIG. 1.

FIG. 2 depicts a system 200 that includes the IVAS codec 102 coupled to a receiving codec 210 (e.g., an IVAS codec) via a network 216. A render and binauralize circuit 218 is coupled to an output of the receiving codec 210. The IVAS codec 102 is coupled to a switch 220 or other input interface configured to receive multiple streams of audio data in one of multiple audio data formats 222. For example, the switch 220 may be configured to select from various input types including N=2 audio streams having a multi-stream stereo format 231, audio streams having an SBA format 232 (e.g., N=4 to 49), audio streams having a multi-channel format 233 (e.g., N=6 (e.g., 5.1) to 12 (e.g., 7.1+4)), or audio streams having an independent streams format 234 (e.g., N=1 to 8, plus spatial metadata), as illustrative, non-limiting examples. Although FIG. 2 depicts particular illustrative examples, in other implementations one or more of the streams of audio data have other properties. To illustrate, the audio streams having an independent streams format 234 may correspond to N=1-4, N=1-12, or any other number of the audio streams. In a particular implementation, the switch 220 is coupled to an audio processor that generates the audio streams, such as the front end audio processor 104 of FIG. 1 and may be configured to dynamically select among input types or a combination of input formats (e.g., on-the-fly switching).

The IVAS codec 102 includes a format pre-processor 202 coupled to a core encoder 204. The format pre-processor 202 is configured to perform one or more pre-processing functions, such as downmixing (DMX), decorrelation, etc. An output of the format pre-processor 202 is provided to core encoder 204. The core encoder 204 includes the stream priority module 110 of FIG. 1 and is configured to determine priorities of each received audio stream and to encode each of the audio streams so that higher priority streams are encoded e.g., using higher bit rates, extended bandwidth; and lower priority streams are encoded e.g., using lower bit rates, reduced bandwidth.

The receiving codec 210 is configured to receive, via the network 216, the bitstream 126 from the IVAS codec 102. For example, the network 216 may include one or more wireless networks, one or more wireline networks, or any combination thereof. In a particular implementation, the network 216 includes 4G/5G voice over long term evolution (VoLTE) or voice over Wi-Fi (VoWiFi) network.

The receiving codec 210 includes a core decoder 212 coupled to a format post-processor 214. The core decoder 212 is configured to decode the encoded portions of encoded audio streams in the bit stream 216 to generate decoded audio streams. For example, the core decoder 212 may generate a first decoded version of the first audio stream 131 of FIG. 1, a second decoded version of the second audio stream 132 of FIG. 1, and a third decoded version of the third audio stream 133 of FIG. 1. The decoded versions of the audio streams may differ from the original audio streams 131-133 due to a restricted transmission bandwidth in the network 216 or lossy compression. However, when audio streams having higher priority are encoded with a higher bit rate, the decoded versions of the higher priority streams are typically higher-accuracy reproductions of the original audio streams than the decoded versions of the lower priority streams. In an example, the directional sources are coded with higher priority configuration or resolution while more diffused sources or sounds may be coded with lower priority configuration. The coding of diffused sounds may rely more on modeling (e.g., reverberation, spreading) based on past frames than the directional sounds. In some implementations, the core decoder 212 is configured to receive and parse a packet that includes encoded frames of multiple streams and that also includes header information indicating a bit allocation among the encoded streams, such as described with reference to FIG. 4. The core decoder 212 is configured to decode the encoded stream data in the packet based on the bit allocation indicated by the header information.

The core decoder 212 is configured to output the decoded versions of the audio streams to the format post-processor 214. The format post-processor 214 is configured to process the decoded versions of the audio streams to have a format that is compatible with the render and binauralize circuit 218. In a particular implementation, the format post-processor 214 is configured to support stereo format, SBA format, multi-channel format, and independent streams (IS) format and is configured to query a format capability of the render and binauralize circuit 218 to select an appropriate output format. The format post-processor 214 is configured to apply the selected format to the decoded versions of the audio streams to generate formatted decoded streams 240.

The render and binauralize circuit 218 is configured to receive the formatted decoded streams 240 and to perform render and binauralization processing to generate one or more output signals 242. For example, in an implementation in which spatial metadata corresponding to audio sources is provided via the bitstream 126 (e.g., an independent streams coding implementation) and is supported by the render and binauralize circuit 218, the spatial metadata is used during generation of the audio signals 242 so that spatial characteristics of the audio sources are emulated during reproduction at an output device (e.g., headphones or a speaker system) coupled to the render and binauralizer circuit 218. In another example, in an implementation in which spatial metadata corresponding to the audio sources is not provided, the render and binauralize circuit 218 may choose locally the physical location of the sources in space.

During operation, audio streams are received at the IVAS codec 102 via the switch 220. For example, the audio streams may be received from the front end audio processor 104 of FIG. 1. The received audio streams have one or more of the formats 222 that are compatible with the IVAS codec 102.

The format pre-processor 202 performs format pre-processing on the audio streams and provides the pre-processed audio streams to the core encoder 204. The core encoder 204 performs priority-based encoding as described in FIG. 1 to the pre-processed audio streams and generates the bitstream 126. The bitstream 126 may have a bit rate that is determined based on a transmission bit rate between the IVAS codec 102 and the receiving codec 210 via the network 216. For example, the IVAS codec 102 and the receiving codec 210 may negotiate a bit rate of the bitstream 126 based on a channel condition of the network 216, and the bit rate may be adjusted during transmission of the bitstream 126 in response to changing network conditions. The IVAS codec 102 may apportion bits to carry encoded information of each of the pre-processed audio streams based on the relative priority of the audio streams, such that the combined encoded audio streams in the bitstream 126 do not exceed the negotiated bit rate. The IVAS codec 102 may, depending on the total bitrate available for coding the independent streams, determine to not code one or more streams and to code only one or more select streams based on the priority configuration and the permutation order of the streams. In one example embodiment, the total bitrate is 24.4 kbps and there are three independent streams to be coded. Based on the network conditions, if the total bit rate is reduced to 13.2 kbps, then the IVAS codec 102 may decide to encode only 2 independent streams out of the three input streams to preserve the intrinsic signal quality of the session while partially sacrificing the spatial quality. Based on the network characteristics, when the total bit rate is again increased to 24.4 kbps, then the IVAS codec 102 may resume coding nominally all three of the streams.

The core decoder 212 receives and decodes the bitstream 126 to generate decoded versions of the pre-processed audio streams. The format post-processor 214 processes the decoded versions to generate the formatted decoded streams 240 that have a format compatible with the render and binauralize circuit 218. The render and binauralize circuit 218 generates the audio signals 242 for reproduction by an output device (e.g., headphones, speakers, etc.).

In some implementations, a core coder or the IVAS codec 102 is configured to perform independent coding of 1 to 6 streams or joint coding of 1 to 3 streams or a mixture of some independent streams and some joint streams, where joint coding is coding of pairs of streams together, and a core decoder of the receiver codec 210 is configured to perform independent decoding of 1 to 6 streams or joint decoding of 1 to 3 streams or a mixture of some independent streams and joint streams. In other implementations, the core coder of the IVAS codec 102 is configured to perform independent coding of 7 or more streams or joint coding of 4 or more streams, and the core decoder of the receiver codec 210 is configured to perform independent decoding of 7 or more streams or joint decoding of 4 or more streams. In another example implementation, low band coding of one or more streams is based on independent coding while the high band coding of one or more streams is based on joint coding.

The format of the audio streams received at the IVAS codec 102 may differ from the format of the decoded streams 240. For example, the IVAS codec 102 may receive and encode the audio streams having a first format, such as the independent streams format 234, and the receiving codec 210 may output the decoded streams 240 having a second format, such as a multi-channel format. Thus, the IVAS codec 102 and the receiving codec 210 enable multi-stream audio data transfer between devices that would otherwise be incapable of such transfer due to using incompatible multi-stream audio formats. In addition, supporting multiple audio stream formats enables IVAS codecs to be implemented in a variety of products and devices that support one or more of the audio stream formats, with little to no redesign or modification of such products or devices.

An illustrative example of a pseudocode input interface for an IVAS coder (e.g., the IVAS codec 102) is depicted in Table 1.

TABLE 1

| |
|---|
| IVAS_ENC.exe -n <N> -IS < 1: θ1, φ1; 2: θ2, φ2; ... N: θN, φN > <total_bitrate> <samplerate> <input> <bitstream> |
| IVAS_DEC.exe -binaural -n <N> <samplerate> <bitstream> <output> |

In Table 1, IVAS_ENC. exe is a command to initiate encoding at the IVAS coder according to the command-line parameters following the command. <N> indicates a number of streams to be encoded. "–IS" is an optional flag that identifies decoding according to an independent streams format. The parameters <1: θ1, φ1; 2: θ2, φ2; . . . N: θN, φN> following the –IS flag indicate a series of: stream numbers (e.g., 1), an azimuth value for string number (e.g., θ1), and an elevation value for the string number (e.g., φ1). In a particular example, these parameters correspond to the spatial metadata 124 of FIG. 1.

The parameter <total_bitrate> corresponds to the total bitrate for coding the N independent streams that are sampled at <samplerate>. In another implementation, each independent stream may be coded at a given bit rate and/or may have a different sample rate (e.g., IS1 (independent stream 1): 10 kilobits per second (kbps), wideband (WB) content, IS2: 20 kbps, super wideband (SWB) content, IS3: 2.0 kbps, SWB comfort noise).

The parameter <input > identifies the input stream data (e.g., a pointer to interleaved streams from the front end audio processor 104 of FIG. 1 (e.g., a buffer that stores interleaved streams 131-133)). The parameter <bitstream> identifies the output bitstream (e.g., a pointer to an output buffer for the bitstream 126).

IVAS_DEC. exe is a command to initiate decoding at the IVAS coder according to the command-line parameters following the command. "–binaural" is an optional command flag that indicates a binaural output format. <N> indicates a number of streams to be decoded, <samplerate> indicates a sample rate of the streams (or alternatively, provides a distinct sample rate for each of the streams), <bitstream> indicates the bitstream to be decoded (e.g., the bitstream 126 received at the receiving coded 210 of FIG. 2), and <output> indicates an output for the decoded bitstreams (e.g., a pointer to a buffer that receives the decoded bitstreams in an interleaved configuration, such as a frame-by-frame interleaving or a continuous stream of interleaved data to be played back on a physical device real-time).

Figure 3:
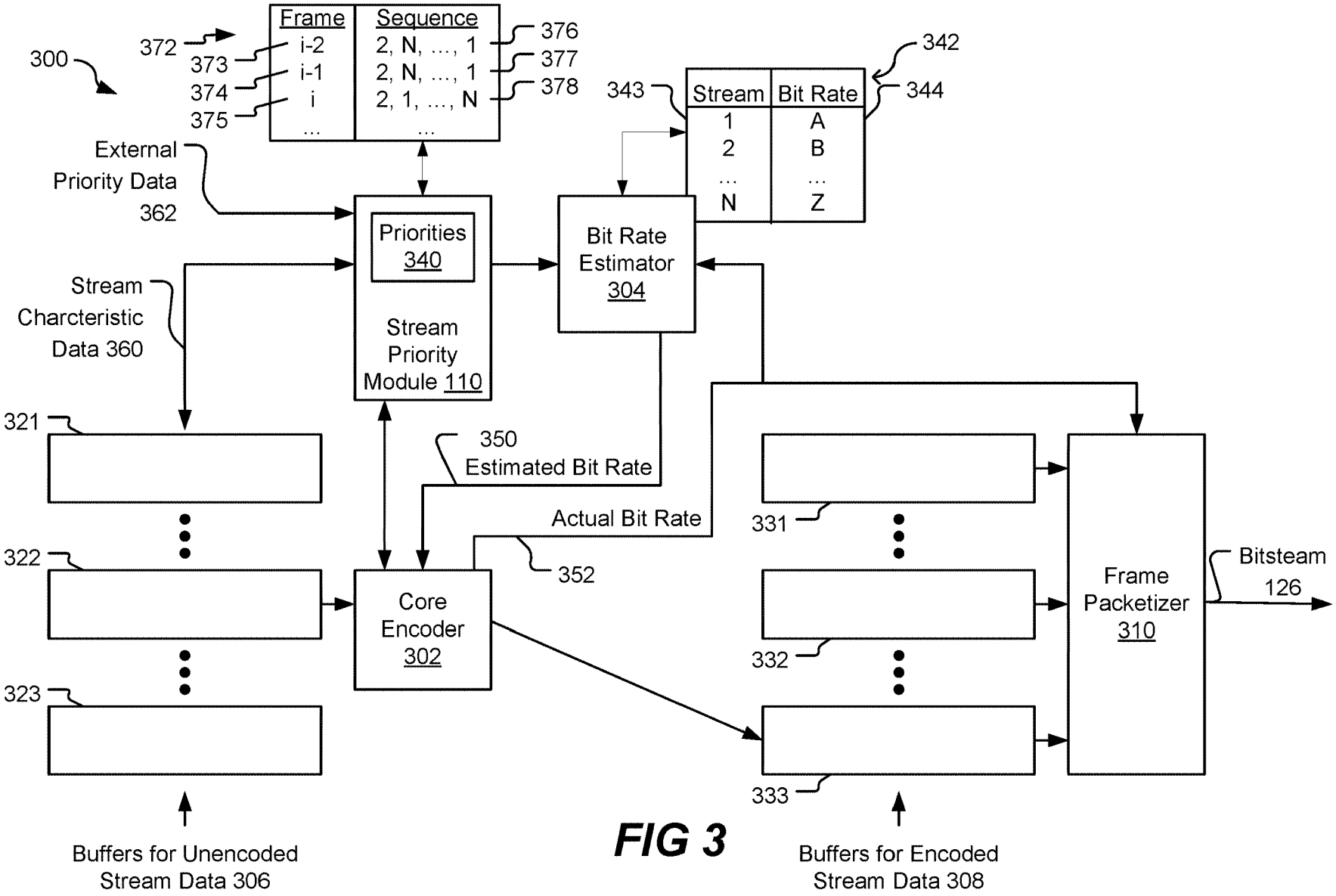
FIG. 3 is a block diagram of components that may be included in the IVAS codec of FIG. 1.

FIG. 3 depicts an example 300 of components that may be implemented in the IVAS codec 102. A first set of buffers 306 for unencoded stream data and a second set of buffers 308 for encoded stream data are coupled to a core encoder 302. The stream priority module 110 is coupled to the core encoder 302 and to a bit rate estimator 304. A frame packetizer 310 is coupled to the second set of buffers 308.

The buffers 306 are configured to receive the multi-stream formatted audio data 122, via multiple separately-received or interleaved streams. Each of the buffers 306 may be configured to store at least one frame of a corresponding stream. In an illustrative example, a first buffer 321 stores an i-th frame of the first stream 131, a second buffer 322 stores an i-th frame of the second stream 132, and a third buffer 323 stores an i-th frame of the third stream 133. After each of the i-th frames has been encoded, each of the buffers 321-323 may receive and store data corresponding to a next frame (an (i+1)-th frame) of its respective stream 131-133. In a pipelined implementation, each of the buffers 306 is sized to store multiple frames of its respective stream 131-133 to enable pre-analysis to be performed on one frame of an audio stream while encoding is performed on another frame of the audio stream.

The stream priority module 110 is configured to access the stream data in the buffers 321-323 and to perform a "pre-analysis" of each stream to determine priorities corresponding to the individual streams. In some implementations, the stream priority module 110 is configured to assign higher priority to streams having higher signal energy and lower priority to streams having lower signal energy. In some implementations, the stream priority module 110 is configured to determine whether each stream corresponds to a background audio source or to a foreground audio source and to assign higher priority to streams corresponding to foreground sources and lower priority to streams corresponding to background sources. In some implementations, the stream priority module 110 is configured to assign higher priority to streams having particular types of content, such as assigning higher priority to streams in which speech content is detected and lower priority to streams in which speech content is not detected. In some implementations, the stream priority module 110 is configured to assign priority based on an entropy of each of the streams. In an illustrative example, higher-entropy streams are assigned higher priority and lower-entropy streams are assigned lower priority. In some implementations, the stream priority module 110 may also configure the permutation order based on e.g., perceptually more important, more "critical" sound to the scene, background sound overlays on top of the other sounds in a scene, directionality relative to diffusiveness, one or more other factors, or any combination thereof.

In an implementation in which the stream priority module 110 receives external priority data 362, such as stream priority information from the front end audio processor 104, the stream priority module 110 assigns priority to the streams at least partially based on the received stream priority information. For example, the front end audio processor 104 may indicate that one or more of the microphones 130 correspond to a user microphone during a teleconference application, and may indicate a relatively high priority for an audio stream that corresponds to the user microphone. Although the stream priority module 110 may be configured to determine stream priority at least partially based on the received priority information, the stream priority module 110 may further be configured to determine stream priority information that does not strictly adhere to received stream priority information. For example, although a stream corresponding to a user voice input microphone during a teleconference application may be indicated as high priority by the external priority data 362, during some periods of the conversation the user may be silent. In response to the stream having relatively low signal energy due to the user's silence, the stream priority module 110 may reduce the priority of the stream to relatively low priority.

In some implementations, the stream priority module 110 is configured to determine each stream's priority for a particular frame (e.g., frame i) at least partially based on the stream's priority or characteristics for one or more preceding frames (e.g., frame (i−1), frame (i−2), etc.) For example, stream characteristics and stream priority may change relatively slowly as compared to a frame duration, and including historical data when determining a stream's priority may reduce audible artifacts during decoding and playback of the stream that may result from large frame-by-frame bit rate variations during encoding of the stream.

The stream priority module 110 is configured to determine a coding order of the streams in the buffers 306 based on the priorities 340. For example, the stream priority module 110 may be configured to assign priority value ranging from 5 (highest priority) to 1 (lowest priority). The stream priority module 110 may sort the streams based on priority so that streams having a priority of 5 are at a beginning of an encoding sequence, followed by streams having priority of 4, followed by streams having priority of 3, followed by streams having priority of 2, followed by streams having priority of 1.

An example table 372 illustrates encoding sequences 376, 377, and 378 corresponding to frame (i−2) 373, frame (i−1) 374, and frame i 375, respectively, of the streams. For frame i−2 373, stream "2" (e.g., the stream 132) has a highest priority and has a first sequential position in the corresponding encoding sequence 376. Stream "N" (e.g., the stream 133) has a next-highest priority and has a second sequential position in the encoding sequence 376. One or more streams (not illustrated) having lower priority than stream N may be included in the sequence 376 after stream N. Stream "1" (e.g., the stream 131) has a lowest priority and has a last sequential position in the encoding sequence 376. Thus, the encoding sequence 376 for encoding the streams of frame (i−2) 373 is: 2, N, . . . , 1.

The table 372 also illustrates that for the next sequential frame (i−1) 374, the encoding sequence 377 is unchanged from the sequence 376 for frame (i−2) 373. To illustrate, the priorities of each of the streams 131-133 relative to each other for frame (i−1) 374 may be unchanged from the priorities for frame (i−2) 373. For a next sequential frame i 375, the positions of stream 1 and stream N in the encoding sequence 378 have switched. For example, stream 2 may correspond to a user speaking during a telephone call and may be identified as high-priority (e.g., priority=5) due to the stream having relatively high signal energy, detected speech, a foreground signal, indicated as important via the external priority data 362, or a combination thereof. Stream 1 may correspond to a microphone proximate to a second person that is silent during frames i−2 and i−1 and that begins speaking during frame i. During frames i−2 and i−1, stream 1 may be identified as low-priority (e.g., priority=1) due to the stream having relatively low signal energy, no detected speech, a background signal, not indicated as important via the external priority data 362, or a combination thereof. However, after capturing the second person's speech in frame i, stream 1 may be identified as high-priority signal (e.g., priority=4) due to having relatively high signal energy, detected speech, and a foreground signal, although not indicated as important via the external priority data 362.

The bit rate estimator 304 is configured to determine an estimated bit rate for encoding each of the streams for a current frame (e.g., frame i) based on the priorities or permutation order 340 of each stream for the current frame, the encoding sequence 376 for the current frame, or a combination thereof. For example, streams having priority 5 may be assigned a highest estimated bit rate, streams having priority 4 may be assigned a next-highest estimated bit rate, and streams having priority 1 may be assigned a lowest estimated bit rate. Estimated bit rate may be determined at least partially based on a total bitrate available for the output bitstream 126, such as by partitioning the total bitrate into larger-sized bit allocations for higher-priority streams and smaller-sized bit allocations for lower-priority streams. The bit rate estimator 304 may be configured to generate a table 343 or other data structure that associates each stream 343 with its assigned estimated bit rate 344. As described previously, in some implementations streams with higher priority are assigned earlier positions in the permutation sequence and may have higher estimated bit rates. In other implementations, a stream's position in the permutation sequence may be independent of that stream's estimated bit rate.

The core encoder 302 is configured to encode at least a portion of each of the streams according to the permutation sequence. For example, to encode the portion of each stream corresponding to frame i 375, the core encoder 302 may receive the encoding sequence 378 from the stream priority module 110 and may encode stream 2 first, followed by encoding stream 1, and encoding stream N last. In implementations in which multiple streams are encodable in parallel, such as where the core encoder 302 includes multiple/joint speech encoders, multiple/joint MCDT encoders, etc., streams are selected for encoding according to the permutation sequence, although multiple streams having different priorities may be encoded at the same time. For example, a priority 5 primary user speech stream may be encoded in parallel with a priority 4 secondary user speech stream, while lower-priority streams are encoded after the higher-priority speech streams.

The core encoder 302 is responsive to the estimated bit rate 350 for a particular stream when encoding a frame for that stream. For example, the core encoder 302 may select a particular coding mode or bandwidth for a particular stream to not exceed the estimated bit rate for the stream. After encoding the current frame for the particular stream, the actual bit rate 352 is provided to the bit rate estimator 304 and to the frame packetizer 310.

The core encoder 302 is configured to write the encoded portion of each stream into a corresponding buffer of the second set of buffers 308. In some implementations the encoder 302 preserves a buffer address of each stream by writing an encoded frame from the buffer 321 into the buffer 331, an encoded frame from the buffer 322 into the buffer 332, and an encoded frame from the buffer 323 into the buffer 333. In another implementation, the encoder write encoded frames into the buffers 308 according to an encoding order, so that an encoded frame of the highest-priority stream is written into the first buffer 331, an encoded frame of the next-highest priority stream is written into the buffer 332, etc.

The bit rate estimator 304 is configured to compare the actual bit rate 352 to the estimated bit rate 350 and to update an estimated bit rate of one or more lower-priority streams based on a difference between the actual bit rate 352 to the estimated bit rate 350. For example, if the estimated bit rate for a stream exceeds the encoded bit rate for the stream, such as when the stream is highly compressible and can be encoded using relatively few bits, additional bit capacity is available for encoding lower-priority streams. If the estimated bit rate for a stream is less than the encoded bit rate for the stream, a reduced bit capacity is available for encoding lower-priority streams. The bit rate estimator 304 may be configured to distribute a "delta" or difference between the estimated bit rate for a stream and the encoded bit rate for the stream equally among all lower-priority streams. As another example, the bit rate estimator 304 may be configured to distribute the "delta" to the next-highest priority stream (if the delta results in reduced available encoding bit rate). It should be noted that other techniques for distributing the "delta" to the lower priority streams may be implemented.

The frame packetizer 310 is configured to generate a frame of the output bitstream 126 by retrieving encoded frame data from the buffers 308 and adding header information (e.g., metadata) to enable decoding at a receiving codec. An example of an output frame format is described with reference to FIG. 4.

During operation, encoding may be performed for the i-th frame of the streams (e.g., N streams having independent streams coding (IS) format). The i-th frame of each of the streams may be received in the buffers 306 and may be pre-analyzed by the stream priority module 110 to assign priority and to determine the encoding sequence 378 (e.g., a permutation of coding order).

The pre-analysis can be based on the source characteristics of frame i, as well as the past frames (i−1, i−2, etc.). The pre-analysis may produce a tentative set of bit rates (e.g., the estimated bit rate for the i-th frame of the n-th stream may be denoted IS_br_tent[i, n]) at which the streams may be encoded, such that the highest priority stream receives the most number of bits and the least priority stream may receive the least number of bits, while preserving a constraint on total bit rate: IS_br_tent[i, 1]+IS_br_tent[i, 2]++IS_br_tent[i, N]<=IS total rate.

The pre-analysis may also produce the permutation order in which the streams are coded (e.g., permutation order for frame i: 2, 1, . . . N; for frame i+1: 1, 3, N, . . . 2, etc.) along with an initial coding configuration that may include, e.g., the core sample rate, coder type, coding mode, active/inactive.

The IS coding of each of the streams may be based on this permutation order, tentative bitrate, initial coding configuration.

In a particular implementation, encoding the n-th priority independent stream (e.g., the stream in the n-th position of the encoding sequence 378) includes: pre-processing to refine the coding configuration and the n-th stream actual bit rate; coding the n-th stream at a bit rate (br) equal to IS_br[i, n] kbps; estimating the delta, i.e., IS_delta[i, n]=(IS_br[i, n]−IS_br_tent[i, n]); adding the delta to next priority stream and updating the (n+1)-th priority stream's estimated (tentative) bit rate, i.e., IS_br_tent[i, n+1]=IS_br[i, n+1]+IS_delta[i, n], or distribute the delta to the rest of the streams in proportion to the bit allocation of each stream of the rest of the streams; and storing the bitstream (e.g., IS_br[i, n] number of bits) associated with the n-th stream temporarily in a buffer, such as in one of the buffers 308.

Figure 4:
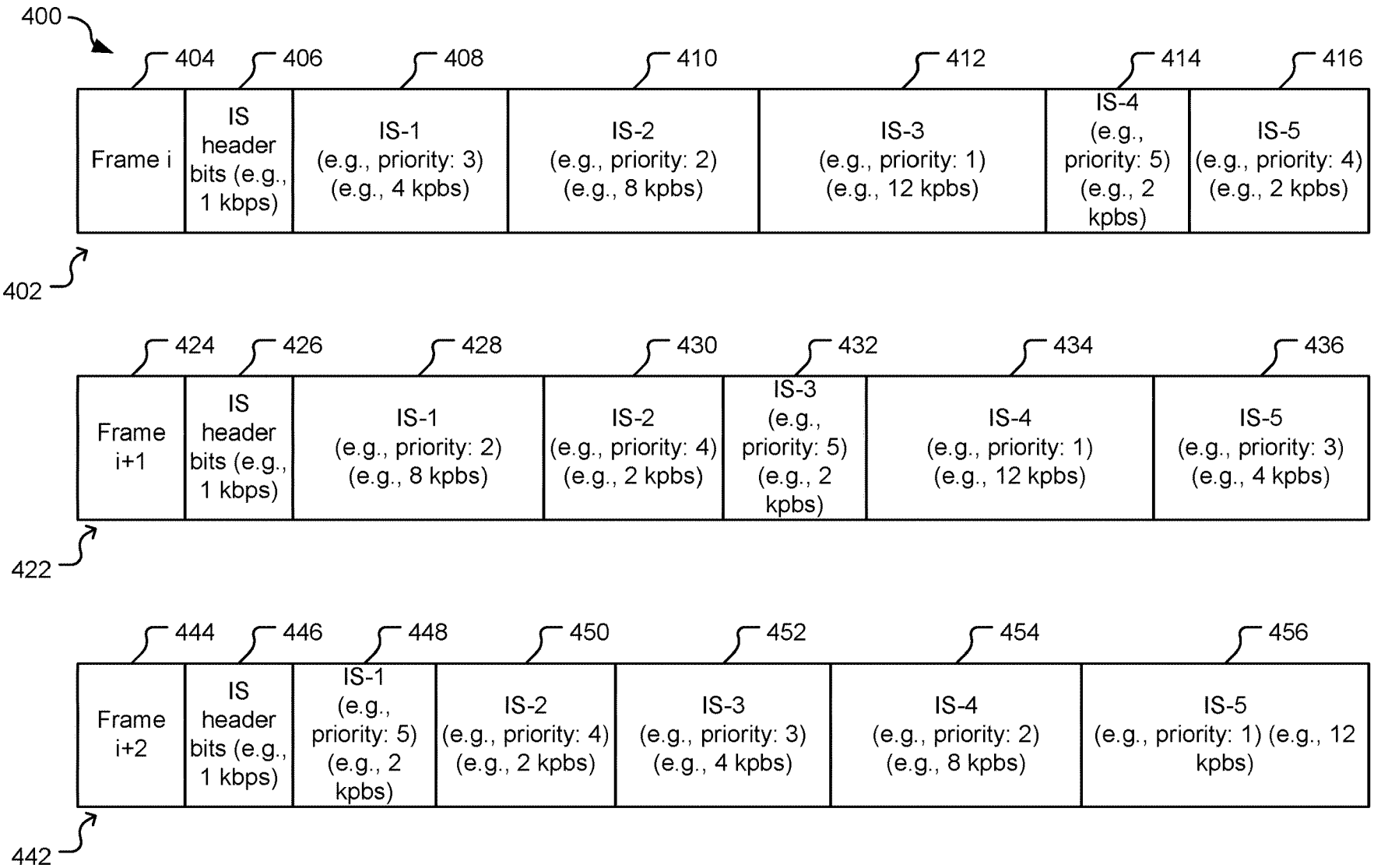
FIG. 4 is a diagram illustrating an example of an output bitstream frame format that may be generated by the IVAS codec of FIG. 1.

The encoding described above is repeated for all the other streams based on their priority permutation order (e.g., according to the encoding sequence 378). Each of the IS bit buffers (e.g., the content of each of the buffers 331-333) may be assembled into the bitstream 126 in a pre-defined order. An example illustration for frames i, i+1, i+2 of the bitstream 126 is depicted in FIG. 4.

Although in some implementations stream priorities or bit allocation configurations may be specified from outside the IVAS codec 102 (e.g., by an application processor), the pre-analysis performed by the IVAS codec 102 has the flexibility to change this bit allocation structure. For example, when external information indicates that one stream is high priority and is supposed to be encoded using a high bitrate, but the stream has inactive content in it in a specific frame, the pre-analysis can detect the inactive content and reduce the stream's bitrate for that frame despite being indicated as high priority.

Although FIG. 3 depicts the table 372 that includes encoding sequences 376-378, it should be understood that the table 372 is illustrated for purpose of explanation and that other implementations of the IVAS codec 102 do not generate a table or other data structure to represent an encoding sequence. For example, in some implementations an encoding sequence is determined via searching priorities of unencoded streams and selecting a highest-priority stream of the unencoded streams until all streams have been encoded for a particular frame, and without generating a dedicated data structure to store the determined encoding sequence. In such implementations, determination of the encoding sequence is performed as encoding is ongoing, rather than being performed as a discrete operation.

Although the stream priority module 110 is described as being configured to determine the stream characteristic data 360, in other implementations a pre-analysis module may instead perform the pre-analysis (e.g., to determine signal energy, entropy, speech detection, etc.) and may provide the stream characteristic data 360 to the stream priority module 110.

Although FIG. 3 depicts the first set of buffers 306 and the second set of buffers 308, in other implementations one or both of the sets of buffers 306 and 308 may be omitted. For example, the first set of buffers 306 may be omitted in implementations in which the core encoder 302 is configured to retrieve interleaved audio stream data from a single buffer. As another example, the second set of buffers 308 may be omitted in implementations in which the core encoder 302 is configured to insert the encoded audio stream data directly into a frame buffer in the frame packetizer 310.

Referring to FIG. 4, an example 400 of frames of the bitstream 126 is depicted for encoded IS audio streams. A first frame (Frame i) 402 includes a frame identifier 404, an IS header 406, encoded audio data for stream 1 (IS-1) 408, encoded audio data for stream 2 (IS-2) 410, encoded audio data for stream 3 (IS-3) 412, encoded audio data for stream 4 (IS-4) 414, and encoded audio data for stream 5 (IS-5) 416.

The IS header 406 carries information regarding the combination of the bit allocations for the IS stream 408-416. For example, the IS header 406 may include the length of each of the IS streams 408-416. Alternatively, each of the IS streams 408-416 may be self-contained and include the length of the IS-coding (e.g., the length of the IS-coding may be encoded into the first 3 bits of each IS stream). Alternatively, or in addition, the bitrate for each of the streams 408-416 may be included in the IS header 406 or may be encoded into the respective IS streams. The IS header may also include or indicate the spatial metadata 124. For example, a quantized version of the spatial metadata 124 may be used where an amount of quantization for each IS stream is based on the priority of the IS stream. To illustrate, spatial metadata encoding for high-priority streams may use 4 bits for azimuth data and 4 bits for elevation data, and spatial metadata encoding for low-priority streams may use 3 bits or fewer for azimuth data and 3 bits or fewer for elevation data. It should be understood that 4 bits is provided as an illustrative, non-limiting example, and in other implementations any other number of bits may be used for azimuth data, for elevation data, or any combination thereof.

A second frame (Frame i+1) 422 includes a frame identifier 424, an IS header 426, encoded audio data for stream 1 (IS-1) 428, encoded audio data for stream 2 (IS-2) 430, encoded audio data for stream 3 (IS-3) 432, encoded audio data for stream 4 (IS-4) 434, and encoded audio data for stream 5 (IS-5) 436. A third frame (Frame i+2) 442 includes a frame identifier 444, an IS header 446, encoded audio data for stream 1 (IS-1) 448, encoded audio data for stream 2 (IS-2) 450, encoded audio data for stream 3 (IS-3) 452, encoded audio data for stream 4 (IS-4) 454, and encoded audio data for stream 5 (IS-5) 456.

Each of the priority streams may use always a fixed number of bits where highest priority stream uses 30-40% of the total bits and the lowest priority stream may use 5-10% of the total bits. Instead of sending the number of bits (or length of the IS-coding), the priority number of the stream may instead be sent, from which a receiver can deduce the length of the IS-coding of the n-th priority stream. In other alternative implementations, transmission of the priority number may be omitted by placing a bitstream of each stream in a specific order of priority (e.g., Ascending or Descending) in the bitstream frame.

It should be understood that the illustrative frames 402, 422, and 442 are encoded using different stream priorities and encoding sequences than the examples provided with reference to FIGS. 1-3. Table 2 illustrates stream priorities and Table 3 illustrates encoding sequences corresponding to encoding of the frames 402, 422, and 442.

TABLE 2

| | Stream Priority Configuration | | |
|---|---|---|---|
| | Frame i | Frame i + 1 | Frame i + 2 |
| Stream IS-1 | 3 | 2 | 5 |
| Stream IS-2 | 2 | 4 | 4 |
| Stream IS-3 | 1 | 5 | 3 |
| Stream IS-4 | 5 | 1 | 2 |
| Stream IS-5 | 4 | 3 | 1 |

TABLE 3

| | Permutation sequence for Encoding |
|---|---|
| Frame i | 3, 2, 1, 5, 4 |
| Frame i + 1 | 4, 1, 5, 2, 3 |
| Frame i + 2 | 5, 4, 3, 2, 1 |

Figure 5:
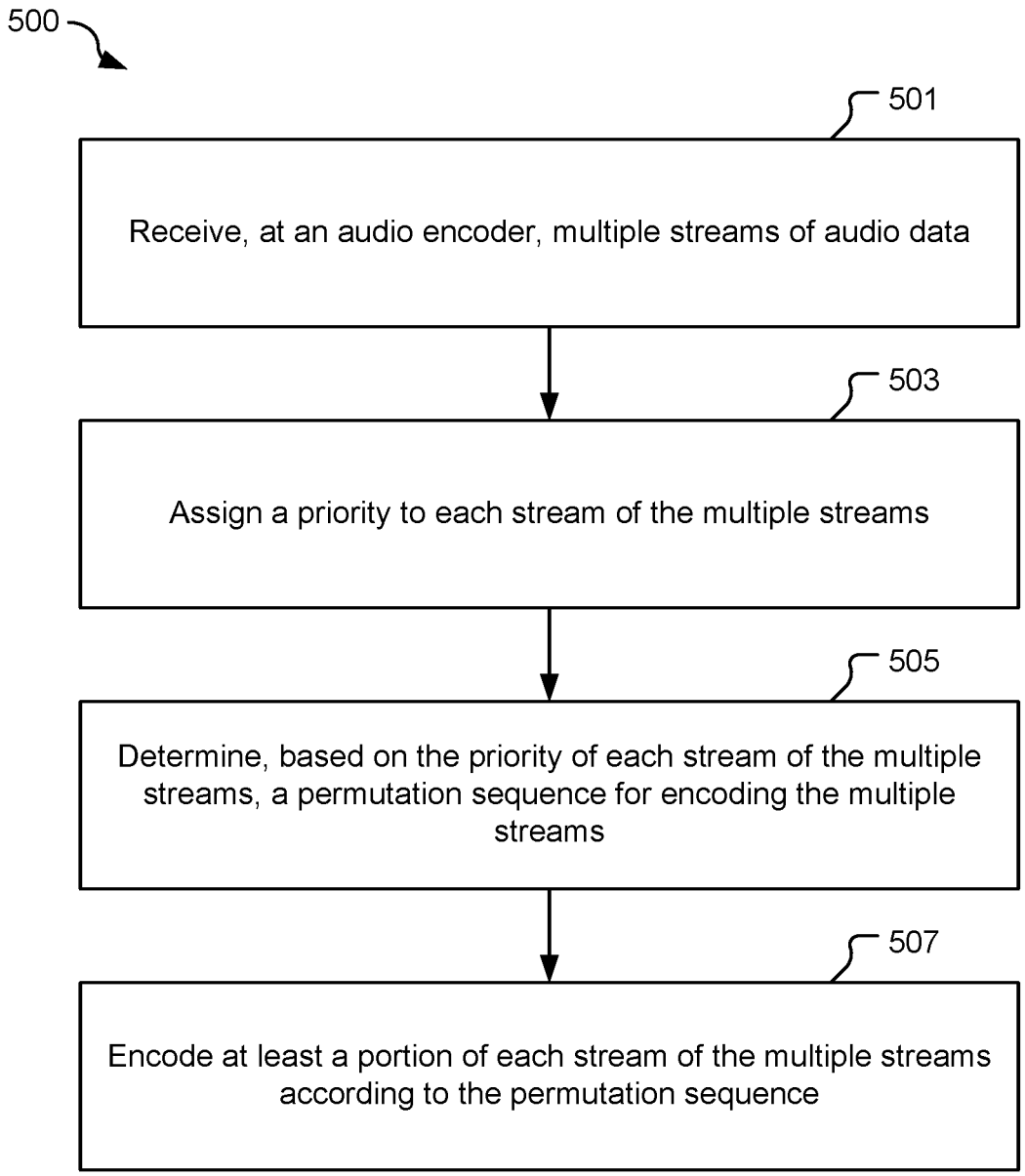
FIG. 5 is a flow chart of a particular example of a method of multi-stream encoding.

FIG. 5 is a flow chart of a particular example of a method 500 of multi-stream encoding. The method 500 may be performed by an encoder, such as the IVAS codec 102 of FIGS. 1-3. For example, the method 500 may be performed at the mobile device 600 of FIG. 6 or the base station 700 of FIG. 7.

The method 500 includes receiving, at an audio encoder, multiple streams of audio data, at 501. In a particular example, the multiple streams correspond to the multi-stream formatted audio data 122 including the N streams 131-133. For example, the multiple streams may have an independent streams coding format, a multichannel format, or a scene-based audio format.

The method 500 includes assigning a priority to each stream of the multiple streams, at 503. In a particular example, the stream priority module 110 assigns a priority to each of the streams 131-133 to generate the priorities 340. The priority of a particular stream of the multiple streams is assigned based on one or more signal characteristics of a frame of the particular stream. In an example implementation the stream priority configuration module 110 may determine the priority or permutation sequence for encoding based on the spatial metadata 124 of each of the streams. In another example, the stream priority configuration module 110 may determine priority or permutation sequence based on input format (e.g., stereo, IS, SBA, or MC), directional or diffused sound, diegetic or non-diegetic (e.g., background commentary) content. In a particular implementation, the one or more signal characteristics includes at least one of a signal energy, a background or foreground determination, detection of speech content, or an entropy. The priority of the particular stream may be assigned further based on one or more signal characteristics of at least one previous frame of the particular stream. Stream priority information (e.g., the external priority data 364) may also be received at the audio encoder from a front end audio processor (e.g., the front end audio processor 104), and the priority of the particular stream is determined at least partially based on the stream priority information.

The method 500 includes determining, based on the priority of each stream of the multiple streams, a permutation sequence for encoding the multiple streams, at 505. In a particular example, the stream priority 110 generates the encoding sequence 376 for the first frame (frame i−2) 373, the encoding sequence 377 for the second frame (frame i−1) 374, and the encoding sequence 378 for the third frame (frame i) 373. In some examples, the permutation sequence is determined in a manner that assigns earlier positions in the permutation sequence to streams with higher priority and later positions in the permutation sequence to streams with lower priority. In another example, the permutation sequence is determined in a manner that assigns an earlier position in the permutation sequence to one or more lower priority streams to generate, based on bit rate(s), coding mode (i.e., ACELP or MDCT, etc), coder type (i.e., Voiced or Unvoiced or Transition, etc) of the one or more encoded lower priority streams, an improved estimate of a bit allocation that is available for encoding a higher priority stream (e.g., at a relatively high bit rate).

The method 500 includes encoding at least a portion of each stream of the multiple streams according to the permutation sequence, at 507. In a particular example, the portion of the stream is a frame, and the encoding is performed frame-by-frame. To illustrate, in FIG. 3, frame i−2 of each of the streams is encoded according to (i.e., in the permutation order designated by) the encoding sequence 376. After encoding frame i−2 of each of the bit streams, frame i−1 of each of the bit streams is encoded according to (i.e., in the permutation order designated by) the encoding sequence 377. After encoding frame i−1 of each of the bit streams, frame i of each of the bit streams is encoded according to (i.e., in the permutation order designated by) the encoding sequence 378.

In an illustrative example, the multiple streams include a first stream and a second stream, and the first stream is assigned a highest priority of the assigned priorities and the second stream is assigned a lowest priority of the assigned priorities. For example, the first stream may correspond to stream 2 of the i-th frame of FIG. 3 and the second stream may correspond to stream N of the i-th frame. The first stream has a first sequential position in the encoding sequence (e.g., stream 2 is at the first sequential position of the encoding sequence 378) and the second stream has a last sequential position in the encoding sequence (e.g., stream N is at the last sequential position of the encoding sequence 378). The encoding of the portion of each stream includes encoding a frame (e.g., frame i) of the first stream to generate a first encoded frame of a first encoded stream and encoding a frame (e.g., frame 1) of the second stream to generate a second encoded frame of a second encoded stream, the first encoded frame having a first bit rate and the second encoded frame having a second bit rate that is less than the first bit rate.

In a particular implementation, the method 400 also includes, prior to encoding the portion of each stream, assigning an estimated bit rate to each stream (e.g., the estimated bit rate 350). The estimated bit rates are assigned so that, for each particular stream of the multiple streams, the estimated bit rate of each stream that has a lower priority than the particular stream is less than or equal to the estimated bit rate of the particular stream. For example, each of the estimated bit rates for streams 1, 3, . . . N for frame i 375 is less than or equal to the estimated bit rate for stream 2. After encoding a portion of a particular stream, the estimated bit rate of at least one stream having a lower priority than the particular stream is updated, such as described with reference to the bit rate estimator 304. Updating the estimated bit rate is based on a difference between the estimated bit rate of the encoded portion of the particular stream and the encoded bit rate of the particular stream.

In some implementations, the method 500 also includes generating a frame that includes each of the encoded portions and sending the frame in an output bitstream to an audio decoder, such as the frame 402 of FIG. 4. The frame includes metadata (e.g., the IS header 406) that indicates at least one of a priority, a bit length, or an encoding bit rate of each stream of the multiple streams. The frame may also include metadata that includes spatial data corresponding each stream of the multiple streams, such as the spatial metadata 124 of FIG. 1, that includes azimuth data and elevation data for each stream of the multiple streams, such as described with reference to Table 1.

Figure 6:
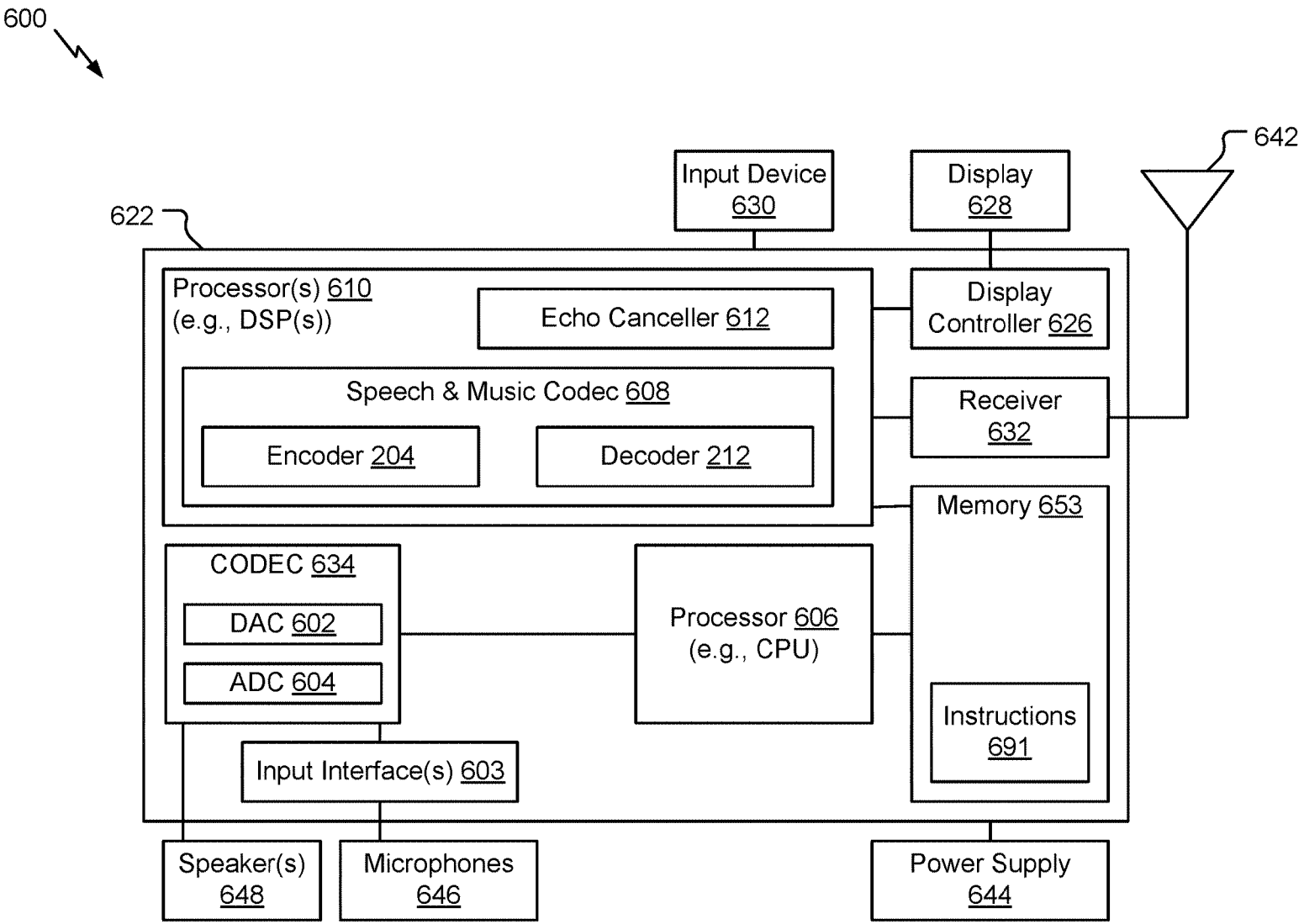
FIG. 6 is a block diagram of a particular illustrative example of a mobile device that is operable to perform multi-stream encoding.

Referring to FIG. 6, a block diagram of a particular illustrative example of a device (e.g., a wireless communication device) is depicted and generally designated 600. In various implementations, the device 600 may have fewer or more components than illustrated in FIG. 6. In an illustrative implementation, the device 600 may correspond to the device 101 of FIG. 1 or the receiving device of FIG. 2. In an illustrative implementation, the device 600 may perform one or more operations described with reference to systems and methods of FIGS. 1-5.

In a particular implementation, the device 600 includes a processor 606 (e.g., a central processing unit (CPU)). The device 600 may include one or more additional processors 610 (e.g., one or more digital signal processors (DSPs)). The processors 610 may include a media (e.g., speech and music) coder-decoder (CODEC) 608, and an echo canceller 612. The media CODEC 608 may include the core encoder 204, the core decoder 212, or a combination thereof. In some implementations, the media CODEC 608 includes the format pre-processor 202, the format post-processor 214, the render and binauralize circuit 218, or a combination thereof.

The device 600 may include a memory 653 and a CODEC 634. Although the media CODEC 608 is illustrated as a component of the processors 610 (e.g., dedicated circuitry and/or executable programming code), in other implementations one or more components of the media CODEC 608, such as the encoder 204, the decoder 212, or a combination thereof, may be included in the processor 606, the CODEC 634, another processing component, or a combination thereof. The CODEC 634 may include one or more digital-to-analog convertors 602 and analog-to-digital convertors 604. The CODEC 634 may include the front-end audio processor 104 of FIG. 1.

The device 600 may include a receiver 632 coupled to an antenna 642. The device 600 may include a display 628 coupled to a display controller 626. One or more speakers 648 may be coupled to the CODEC 634. One or more microphones 646 may be coupled, via one or more input interface(s) 603, to the CODEC 534. In a particular implementation, the microphones 646 may include the microphones 106-109.

The memory 653 may include instructions 691 executable by the processor 606, the processors 610, the CODEC 634, another processing unit of the device 600, or a combination thereof, to perform one or more operations described with reference to FIGS. 1-5.

One or more components of the device 600 may be implemented via dedicated hardware (e.g., circuitry), by a processor executing instructions to perform one or more tasks, or a combination thereof. As an example, the memory 653 or one or more components of the processor 606, the processors 610, and/or the CODEC 634 may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 691) that, when executed by a computer (e.g., a processor in the CODEC 634, the processor 606, and/or the processors 610), may cause the computer to perform one or more operations described with reference to FIGS. 1-5. As an example, the memory 653 or the one or more components of the processor 606, the processors 610, and/or the CODEC 634 may be a non-transitory computer-readable medium that includes instructions (e.g., the instructions 691) that, when executed by a computer (e.g., a processor in the CODEC 634, the processor 606, and/or the processors 610), cause the computer perform one or more operations described with reference to FIGS. 1-5.

In a particular implementation, the device 600 may be included in a system-in-package or system-on-chip device (e.g., a mobile station modem (MSM)) 622. In a particular implementation, the processor 606, the processors 610, the display controller 626, the memory 653, the CODEC 634, and the receiver 632 are included in a system-in-package or the system-on-chip device 622. In a particular implementation, an input device 630, such as a touchscreen and/or keypad, and a power supply 644 are coupled to the system-on-chip device 622. Moreover, in a particular implementation, as illustrated in FIG. 6, the display 628, the input device 630, the speakers 648, the microphones 646, the antenna 642, and the power supply 644 are external to the system-on-chip device 622. However, each of the display 628, the input device 630, the speakers 648, the microphones 646, the antenna 642, and the power supply 644 can be coupled to a component of the system-on-chip device 622, such as an interface or a controller.

The device 600 may include a wireless telephone, a mobile communication device, a mobile phone, a smart phone, a cellular phone, a laptop computer, a desktop computer, a computer, a tablet computer, a set top box, a personal digital assistant (PDA), a display device, a television, a gaming console, a music player, a radio, a video player, an entertainment unit, a communication device, a fixed location data unit, a personal media player, a digital video player, a digital video disc (DVD) player, a tuner, a camera, a navigation device, a decoder system, an encoder system, or any combination thereof.

Figure 7:
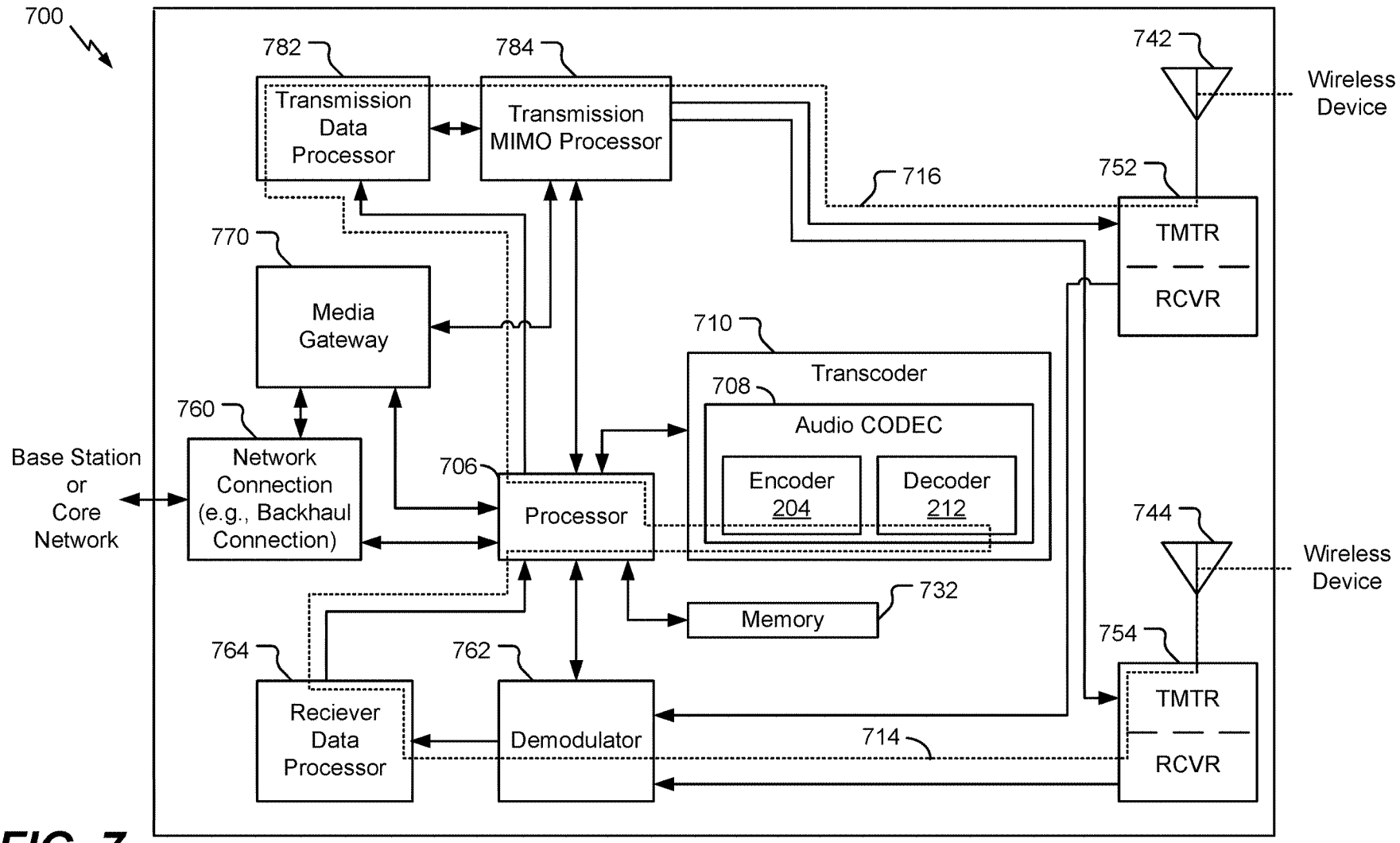
FIG. 7 is a block diagram of a particular example of a base station that is operable to perform multi-stream encoding.

Referring to FIG. 7, a block diagram of a particular illustrative example of a base station 700 is depicted. In various implementations, the base station 700 may have more components or fewer components than illustrated in FIG. 7. In an illustrative example, the base station 700 may include the first device 101 of FIG. 1. In an illustrative example, the base station 700 may operate according to one or more of the methods or systems described with reference to FIGS. 1-5.

The base station 700 may be part of a wireless communication system. The wireless communication system may include multiple base stations and multiple wireless devices. The wireless communication system may be a Long Term Evolution (LTE) system, a Code Division Multiple Access (CDMA) system, a Global System for Mobile Communications (GSM) system, a wireless local area network (WLAN) system, or some other wireless system. A CDMA system may implement Wideband CDMA (WCDMA), CDMA 1X, Evolution-Data Optimized (EVDO), Time Division Synchronous CDMA (TD-SCDMA), or some other version of CDMA.

The wireless devices may also be referred to as user equipment (UE), a mobile station, a terminal, an access terminal, a subscriber unit, a station, etc. The wireless devices may include a cellular phone, a smartphone, a tablet, a wireless modem, a personal digital assistant (PDA), a handheld device, a laptop computer, a smartbook, a netbook, a tablet, a cordless phone, a wireless local loop (WLL) station, a Bluetooth device, etc. The wireless devices may include or correspond to the device 600 of FIG. 6.

Various functions may be performed by one or more components of the base station 700 (and/or in other components not shown), such as sending and receiving messages and data (e.g., audio data). In a particular example, the base station 700 includes a processor 706 (e.g., a CPU). The base station 700 may include a transcoder 710. The transcoder 710 may include an audio CODEC 708. For example, the transcoder 710 may include one or more components (e.g., circuitry) configured to perform operations of the audio CODEC 708. As another example, the transcoder 710 may be configured to execute one or more computer-readable instructions to perform the operations of the audio CODEC 708. Although the audio CODEC 708 is illustrated as a component of the transcoder 710, in other examples one or more components of the audio CODEC 708 may be included in the processor 706, another processing component, or a combination thereof. For example, a decoder 738 (e.g., a vocoder decoder) may be included in a receiver data processor 764. As another example, an encoder 736 (e.g., a vocoder encoder) may be included in a transmission data processor 782.

The transcoder 710 may function to transcode messages and data between two or more networks. The transcoder 710 may be configured to convert message and audio data from a first format (e.g., a digital format) to a second format. To illustrate, the decoder 738 may decode encoded signals having a first format and the encoder 736 may encode the decoded signals into encoded signals having a second format. Additionally or alternatively, the transcoder 710 may be configured to perform data rate adaptation. For example, the transcoder 710 may down-convert a data rate or up-convert the data rate without changing a format the audio data. To illustrate, the transcoder 710 may down-convert 64 kbit/s signals into 16 kbit/s signals.

The audio CODEC 708 may include the core encoder 204 and the core decoder 212. The audio CODEC 708 may also include the format pre-processor 202, the format post-processor 214, or a combination thereof.

The base station 700 may include a memory 732. The memory 732, such as a computer-readable storage device, may include instructions. The instructions may include one or more instructions that are executable by the processor 706, the transcoder 710, or a combination thereof, to perform one or more operations described with reference to the methods and systems of FIGS. 1-5. The base station 700 may include multiple transmitters and receivers (e.g., transceivers), such as a first transceiver 752 and a second transceiver 754, coupled to an array of antennas. The array of antennas may include a first antenna 742 and a second antenna 744. The array of antennas may be configured to wirelessly communicate with one or more wireless devices, such as the device 600 of FIG. 6. For example, the second antenna 744 may receive a data stream 714 (e.g., a bitstream) from a wireless device. The data stream 714 may include messages, data (e.g., encoded speech data), or a combination thereof.

The base station 700 may include a network connection 760, such as backhaul connection. The network connection 760 may be configured to communicate with a core network or one or more base stations of the wireless communication network. For example, the base station 700 may receive a second data stream (e.g., messages or audio data) from a core network via the network connection 760. The base station 700 may process the second data stream to generate messages or audio data and provide the messages or the audio data to one or more wireless device via one or more antennas of the array of antennas or to another base station via the network connection 760. In a particular implementation, the network connection 760 may be a wide area network (WAN) connection, as an illustrative, non-limiting example. In some implementations, the core network may include or correspond to a Public Switched Telephone Network (PSTN), a packet backbone network, or both.

The base station 700 may include a media gateway 770 that is coupled to the network connection 760 and the processor 706. The media gateway 770 may be configured to convert between media streams of different telecommunications technologies. For example, the media gateway 770 may convert between different transmission protocols, different coding schemes, or both. To illustrate, the media gateway 770 may convert from PCM signals to Real-Time Transport Protocol (RTP) signals, as an illustrative, non-limiting example. The media gateway 770 may convert data between packet switched networks (e.g., a Voice Over Internet Protocol (VoIP) network, an IP Multimedia Subsystem (IMS), a fourth generation (4G) wireless network, such as LTE, WiMax, and UMB, etc.), circuit switched networks (e.g., a PSTN), and hybrid networks (e.g., a second generation (2G) wireless network, such as GSM, GPRS, and EDGE, a third generation (3G) wireless network, such as WCDMA, EV-DO, and HSPA, etc.).

Additionally, the media gateway 770 may include a transcode and may be configured to transcode data when codecs are incompatible. For example, the media gateway 770 may transcode between an Adaptive Multi-Rate (AMR) codec and a G.711 codec, as an illustrative, non-limiting example. The media gateway 770 may include a router and a plurality of physical interfaces. In some implementations, the media gateway 770 may also include a controller (not shown). In a particular implementation, the media gateway controller may be external to the media gateway 770, external to the base station 700, or both. The media gateway controller may control and coordinate operations of multiple media gateways. The media gateway 770 may receive control signals from the media gateway controller and may function to bridge between different transmission technologies and may add service to end-user capabilities and connections.

The base station 700 may include a demodulator 762 that is coupled to the transceivers 752, 754, the receiver data processor 764, and the processor 706, and the receiver data processor 764 may be coupled to the processor 706. The demodulator 762 may be configured to demodulate modulated signals received from the transceivers 752, 754 and to provide demodulated data to the receiver data processor 764. The receiver data processor 764 may be configured to extract a message or audio data from the demodulated data and send the message or the audio data to the processor 706.

The base station 700 may include a transmission data processor 782 and a transmission multiple input-multiple output (MIMO) processor 784. The transmission data processor 782 may be coupled to the processor 706 and the transmission MIMO processor 784. The transmission MIMO processor 784 may be coupled to the transceivers 752, 754 and the processor 706. In some implementations, the transmission MIMO processor 784 may be coupled to the media gateway 770. The transmission data processor 782 may be configured to receive the messages or the audio data from the processor 706 and to code the messages or the audio data based on a coding scheme, such as CDMA or orthogonal frequency-division multiplexing (OFDM), as an illustrative, non-limiting examples. The transmission data processor 782 may provide the coded data to the transmission MIMO processor 784.

The coded data may be multiplexed with other data, such as pilot data, using CDMA or OFDM techniques to generate multiplexed data. The multiplexed data may then be modulated (i.e., symbol mapped) by the transmission data processor 782 based on a particular modulation scheme (e.g., Binary phase-shift keying ("BPSK"), Quadrature phase-shift keying ("QSPK"), M-ary phase-shift keying ("M-PSK"), M-ary Quadrature amplitude modulation ("M-QAM"), etc.) to generate modulation symbols. In a particular implementation, the coded data and other data may be modulated using different modulation schemes. The data rate, coding, and modulation for each data stream may be determined by instructions executed by processor 706.

The transmission MIMO processor 784 may be configured to receive the modulation symbols from the transmission data processor 782 and may further process the modulation symbols and may perform beamforming on the data. For example, the transmission MIMO processor 784 may apply beamforming weights to the modulation symbols. The beamforming weights may correspond to one or more antennas of the array of antennas from which the modulation symbols are transmitted.

During operation, the second antenna 744 of the base station 700 may receive a data stream 714. The second transceiver 754 may receive the data stream 714 from the second antenna 744 and may provide the data stream 714 to the demodulator 762. The demodulator 762 may demodulate modulated signals of the data stream 714 and provide demodulated data to the receiver data processor 764. The receiver data processor 764 may extract audio data from the demodulated data and provide the extracted audio data to the processor 706.

The processor 706 may provide the audio data to the transcoder 710 for transcoding. The decoder 738 of the transcoder 710 may decode the audio data from a first format into decoded audio data and the encoder 736 may encode the decoded audio data into a second format. In some implementations, the encoder 736 may encode the audio data using a higher data rate (e.g., up-convert) or a lower data rate (e.g., down-convert) than received from the wireless device. In other implementations, the audio data may not be transcoded. Although transcoding (e.g., decoding and encoding) is illustrated as being performed by a transcoder 710, the transcoding operations (e.g., decoding and encoding) may be performed by multiple components of the base station 700. For example, decoding may be performed by the receiver data processor 764 and encoding may be performed by the transmission data processor 782. In other implementations, the processor 706 may provide the audio data to the media gateway 770 for conversion to another transmission protocol, coding scheme, or both. The media gateway 770 may provide the converted data to another base station or core network via the network connection 760.

Encoded audio data generated at the encoder 736, such as transcoded data, may be provided to the transmission data processor 782 or the network connection 760 via the processor 706. The transcoded audio data from the transcoder 710 may be provided to the transmission data processor 782 for coding according to a modulation scheme, such as OFDM, to generate the modulation symbols. The transmission data processor 782 may provide the modulation symbols to the transmission MIMO processor 784 for further processing and beamforming. The transmission MIMO processor 784 may apply beamforming weights and may provide the modulation symbols to one or more antennas of the array of antennas, such as the first antenna 742 via the first transceiver 752. Thus, the base station 700 may provide a transcoded data stream 716, that corresponds to the data stream 714 received from the wireless device, to another wireless device. The transcoded data stream 716 may have a different encoding format, data rate, or both, than the data stream 714. In other implementations, the transcoded data stream 716 may be provided to the network connection 760 for transmission to another base station or a core network.

In a particular implementation, one or more components of the systems and devices disclosed herein may be integrated into a decoding system or apparatus (e.g., an electronic device, a CODEC, or a processor therein), into an encoding system or apparatus, or both. In other implementations, one or more components of the systems and devices disclosed herein may be integrated into a wireless telephone, a tablet computer, a desktop computer, a laptop computer, a set top box, a music player, a video player, an entertainment unit, a television, a game console, a navigation device, a communication device, a personal digital assistant (PDA), a fixed location data unit, a personal media player, or another type of device.

In conjunction with the described techniques, an apparatus includes means for assigning a priority to each stream of multiple streams of audio data and for determining, based on the priority of each stream of the multiple streams, an encoding sequence of the multiple streams. For example, the means for assigning and for determining may correspond to the stream priority module 110 of FIGS. 1-3, one or more other devices, circuits, modules, or any combination thereof.

The apparatus also includes means for encoding at least a portion of each stream of the multiple streams according to the encoding sequence. For example, the means for encoding may include the core encoder 302 of FIG. 3, one or more other devices, circuits, modules, or any combination thereof.

It should be noted that various functions performed by the one or more components of the systems and devices disclosed herein are described as being performed by certain components or modules. This division of components and modules is for illustration only. In an alternate implementation, a function performed by a particular component or module may be divided amongst multiple components or modules. Moreover, in an alternate implementation, two or more components or modules may be integrated into a single component or module. Each component or module may be implemented using hardware (e.g., a field-programmable gate array (FPGA) device, an application-specific integrated circuit (ASIC), a DSP, a controller, etc.), software (e.g., instructions executable by a processor), or any combination thereof.

Those of skill would further appreciate that the various illustrative logical blocks, configurations, modules, circuits, and algorithm steps described in connection with the implementations disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the implementations disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an application-specific integrated circuit (ASIC). The ASIC may reside in a computing device or a user terminal. In the alternative, the processor and the storage medium may reside as discrete components in a computing device or a user terminal.

The previous description of the disclosed implementations is provided to enable a person skilled in the art to make or use the disclosed implementations. Various modifications to these implementations will be readily apparent to those skilled in the art, and the principles defined herein may be applied to other implementations without departing from the scope of the disclosure. Thus, the present disclosure is not intended to be limited to the implementations shown herein but is to be accorded the widest scope possible consistent with the principles and novel features as defined by the following claims.

What is claimed is:

1. A method comprising:

receiving, at an audio encoder, multiple streams of audio data;

assigning a priority to each stream of the multiple streams;

determining, based on the priority of each stream of the multiple streams, a permutation sequence for encoding of the multiple streams; and encoding at least a portion of each stream of the multiple streams according to the permutation sequence.

2. The method of claim 1, wherein:

the multiple streams include a first stream and a second stream;

the first stream is assigned a highest priority of the assigned priorities and the second stream is assigned a lowest priority of the assigned priorities;

the first stream has a first sequential position in the permutation sequence and the second stream has a last sequential position in the permutation sequence; and the encoding of the portion of each stream includes encoding a frame of the first stream to generate a first encoded frame of a first encoded stream and encoding a frame of the second stream to generate a second encoded frame of a second encoded stream, the first encoded frame having a first bit rate and the second encoded frame having a second bit rate that is less than the first bit rate.

3. The method of claim 1, further comprising, prior to encoding the portion of each stream, assigning an estimated bit rate to each stream.

4. The method of claim 3, wherein the estimated bit rates are assigned so that, for each particular stream of the multiple streams, the estimated bit rate of each stream that has a lower priority than the particular stream is less than or equal to the estimated bit rate of the particular stream.

5. The method of claim 3, further comprising, after encoding a portion of a particular stream, updating the estimated bit rate of at least one stream having a lower priority than the particular stream, wherein updating the estimated bit rate is based on a difference between the estimated bit rate of the encoded portion of the particular stream and the encoded bit rate of the particular stream.

6. The method of claim 1, wherein the priority of a particular stream of the multiple streams is assigned based on one or more signal characteristics of a frame of the particular stream.

7. The method of claim 6, wherein the one or more signal characteristics includes at least one of a signal energy, a background or foreground determination, detection of speech content, or an entropy.

8. The method of claim 6, wherein the priority of the particular stream is assigned further based on one or more signal characteristics of at least one previous frame of the particular stream.

9. The method of claim 6, further comprising:

receiving, at the audio encoder, stream priority information from a front end audio processor; and determining the priority of the particular stream at least partially based on the stream priority information.

10. The method of claim 1, wherein the multiple streams have an independent streams coding format.

11. The method of claim 1, wherein the multiple streams have a multichannel format.

12. The method of claim 1, wherein the multiple streams have a scene-based audio format.

13. The method of claim 1, further comprising generating a frame that includes each of the encoded portions and sending the frame in an output bitstream to an audio decoder.

14. The method of claim 13, wherein the frame includes metadata that indicates at least one of a priority, a bit length, or an encoding bit rate of each stream of the multiple streams.

15. The method of claim 13, wherein the frame includes metadata that includes spatial data corresponding to each stream of the multiple streams.

16. The method of claim 15, wherein the spatial data includes azimuth data and elevation data for each stream of the multiple streams.

17. The method of claim 15, wherein the metadata includes higher-accuracy spatial data corresponding to higher-priority streams and lower-accuracy spatial data corresponding to lower-priority streams.

18. The method of claim 1, wherein assigning the priorities to the multiple streams and encoding the portions of the multiple streams are performed at a mobile device.

19. The method of claim 1, wherein assigning the priorities to the multiple streams and encoding the portions of the multiple streams are performed at a base station.

20. A device comprising:

an audio processor configured to generate multiple streams of audio data based on received audio signals; and an audio encoder configured to:

assign a priority to each stream of the multiple streams;

determine, based on the priority of each stream of the multiple streams, a permutation sequence for encoding the multiple streams; and encode at least a portion of each stream of the multiple streams according to the permutation sequence.

21. The device of claim 20, further comprising multiple microphones coupled to the audio processor and configured to generate the audio signals.

22. The device of claim 20, wherein the audio encoder is configured to assign the priority of a particular stream of the multiple streams based on one or more signal characteristics of a frame of the particular stream.

23. The device of claim 20, wherein the audio processor and the audio encoder are integrated into a base station.

24. The device of claim 20, wherein the audio processor and the audio encoder are integrated into a mobile device.

25. An apparatus comprising:

means for assigning a priority to each stream of multiple streams of audio data and for determining, based on the priority of each stream of the multiple streams, a permutation sequence for encoding the multiple streams; and means for encoding at least a portion of each stream of the multiple streams according to the permutation sequence.

26. The apparatus of claim 25, further comprising means for generating the multiple streams of audio data.

27. A device comprising:

a decoder configured to:

receive a bitstream that includes:

encoded portions of audio streams, wherein the encoded portions are encoded according to a permutation sequence that is based on an assigned priority of each of the audio streams; and metadata that indicates a bit allocation of each of the encoded portions of the audio streams; and decode the encoded portions of the audio streams based on the bit allocation of each of the encoded portions to generate decoded audio streams.

28. The device of claim 27, wherein the decoder is integrated into a mobile device.

29. The device of claim 27, wherein the metadata indicates at least one of the assigned priority, a bit length, or an encoding bit rate of each of the audio streams.

30. The device of claim 29, wherein the metadata further includes spatial data corresponding to each of the audio streams.

* * * * *